United States Patent [19]

Ray

[11] 4,278,274

[45] Jul. 14, 1981

[54] SKIER'S WARNING DEVICE

[76] Inventor: Gene S. Ray, 1360 Forest Ave., Carlsbad, Calif. 92008

[21] Appl. No.: 40,757

[22] Filed: May 21, 1979

[51] Int. Cl.[3] ..... A63C 11/22

[52] U.S. Cl. ..... 280/821; 135/66

[58] Field of Search ..... 280/11.37 E, 11.37 H, 280/11.37 B, 11.37 D, 809, 816, 819, 821, 822; 135/66

[56] References Cited

U.S. PATENT DOCUMENTS 1,066,540 7/1913 Smithwick ..... 135/66

FOREIGN PATENT DOCUMENTS 2209707 9/1973 Fed. Rep. of Germany .... 280/11.37 E
2638671 3/1978 Fed. Rep. of Germany .... 280/11.37 E
642554 8/1962 Italy ..... 280/11.37 H

*Primary Examiner*—David M. Mitchell
*Assistant Examiner*—D. W. Underwood
*Attorney, Agent, or Firm*—Brown and Martin

[57] ABSTRACT

A warning device for skiers includes an audible sonic generator mounted on a ski pole grip with an actuating button for activating the warning device.

1 Claim, 4 Drawing Figures

SKIER'S WARNING DEVICE

BACKGROUND OF THE INVENTION

The present invention relates to ski equipment and pertains particularly to a warning device for skiers.

Skiing has become quite a popular sport in recent years and skiing areas and ski slopes become quite crowded during the skiing season. The crowding of the ski slopes can create a substantial traffic hazard.

Many injuries on ski slopes occur because of collision between skiers. While it is often common or preferred procedure for a skier to call out a warning to other skiers being overtaken, such is not always done. The result is that a skier being overtaken, may inadvertently turn into the path of the faster skier resulting in a collision and an injury.

It is therefore desirable that some quick, easy and convenient means be available for warning skiers of oncoming traffic and the like.

SUMMARY AND OBJECTS OF THE INVENTION

It is accordingly the primary object of the present invention to provide a skier's warning device.

Another object of the present invention is to provide a simple, easy and convenient warning device for skiers that is mounted on the ski pole.

Another object of the present invention is to provide an inexpensive, audible warning device carried in the handle of a ski pole for quick, easy and convenient utilization.

In accordance with the primary aspect of the present invention, a skier's warning device includes an audible, sonic transducer, mounted on a ski pole and powered by an electrical battery with a conveniently located activating switch means.

BRIEF DESCRIPTION OF THE DRAWINGS

The above and other objects and advantages of the present invention will become apparent from the following description, when read in conjunction with the drawings, wherein.

Figure 1:
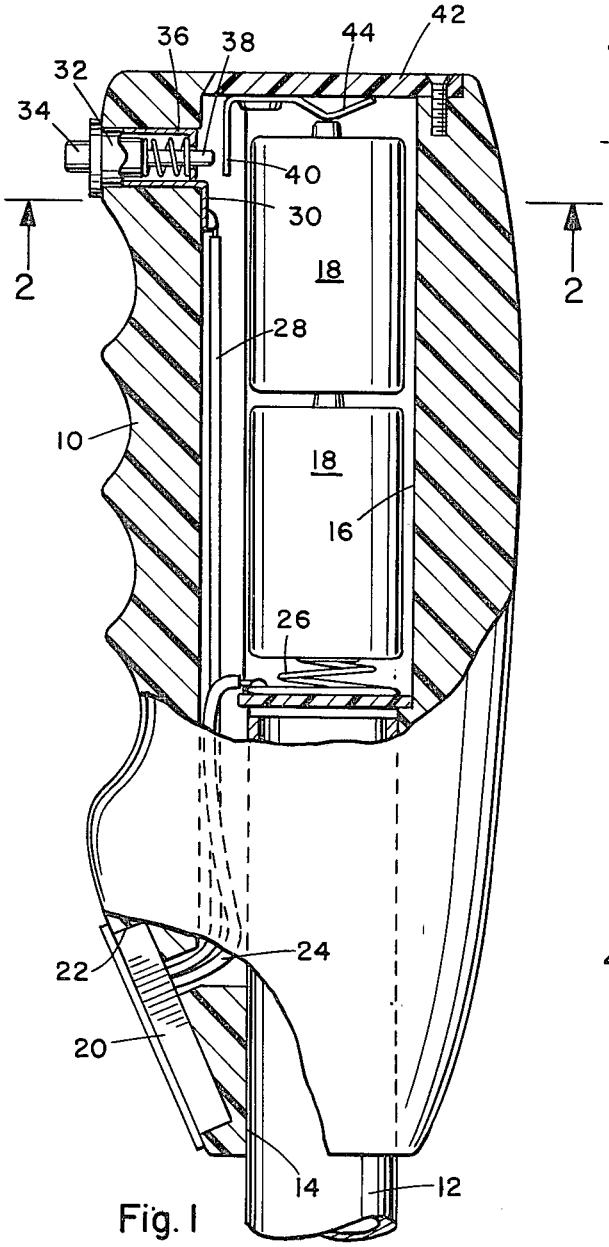
FIG. 1 is a side elevational view partially cut away, of a ski pole grip with the warning device incorporated in the grip.

Turning now to the drawings, particularly FIG. 1 there is illustrated a warning device in accordance with the present invention which comprises a ski pole grip 10 of a generally conventional configuration mounted on the upper end of a ski pole 12. The ski pole grip is provided with a cylindrical first bore 14 in which the ski pole 12 is fitted, and a second bore 16 in which is mounted the power source in the form of a pair of dry cell batteries 18.

An audible sonic transducer or generator 20 is mounted in a suitable place in the grip 10, such as the lower forward edge thereof in a recess 22. The audible generator is of the type such as those in miniature form which is commonly found or utilized in small inexpensive burgular alarms and the like. Such generators are generally available from electronics parts and catalog stores.

The grip 10 is preferably formed of a suitable molded plastic or the like into a shape and configuration that easily fits the hand. The preferred grip is of a common shape and configuration typically used in grips today.

The sonic or audible sound generator 22 is connected into an electrical circuit which includes a conductor 24 which is connected at one end to the audible generator, and at the other end to a contact spring 26 which engages the underside of the lower battery 18. The other portion of the circuit includes a conductor 28 which is connected at one end into the sonic generator or circuit, and at the other end to a switch contact 30 of a switch 32. The switch 32 includes a push button 34 that is spring biased by means of a spring 36 into the outward non-contacting position. The switch is thus normally open and is closed by pressing the button 34 and forcing the contact plunger 38 into engagement with a contact member 40. The contact member 40 as illustrated is mounted in a cap 42 of the hand grip 10 covering the open bore 16. The contact includes a biased or spring end portion 44 which engages the upper pole or electrode of the upper battery 18.

The button 34 of the switch 32 is preferably located in a convenient position such as near the upper inside position of the grip such that it can be easily pressed by, for example, the thumb or forefinger of a skier. Thus as a skier is approaching another skier on a run he simply presses the button 34 to warn of his approach. When the button 34 is released, the circuit is open and the system then deactivated.

Figure 2:
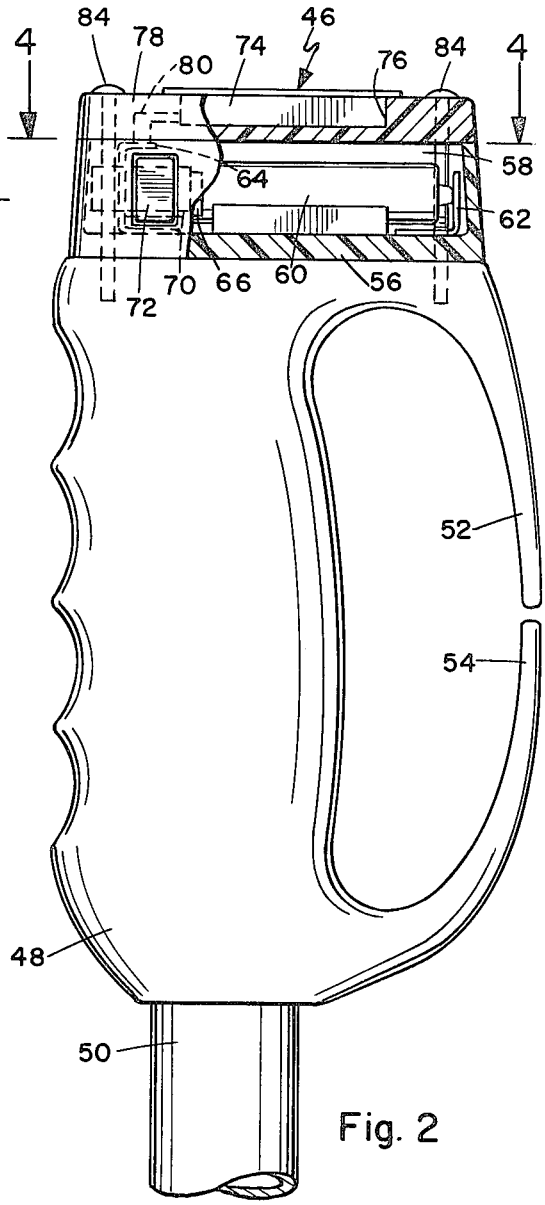
FIG. 2 is a side elevational view of a ski pole grip with the warning device attached to the top of the grip.
Figure 3:
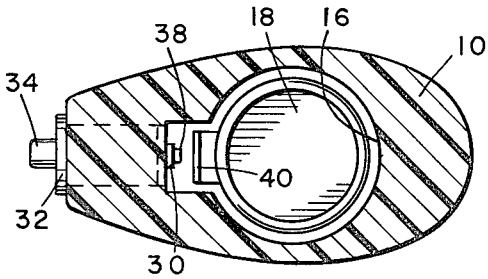
FIG. 3 is a sectional view taken on line 2—2 of FIG. 1.
Figure 4:
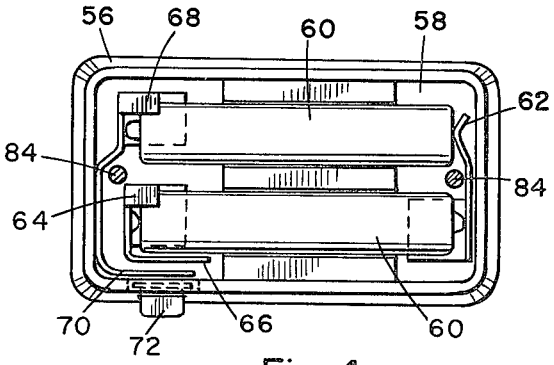
FIG. 4 is a sectional view taken on line 4—4 of FIG. 3.

Turning now to FIGS. 2 and 4, an alternate embodiment of the invention is illustrated. This embodiment includes a warning device designated generally by the numeral 46 mounted on the upper end for example of a conventional ski pole grip 48. The grip 48 is typically of a molded plastic or the like and is of a type that is popular and found on ski poles today. The grip is mounted on the upper end of a pole 50 and includes a hand receiving slot formed between a pair of overlapping or overreaching fingers 52 and 54. The hand fits into the slot between the fingers and the body of the grip, with the fingers extending around and fitting into the formed face portion.

An audible warning generator or warning device in accordance with the invention is mounted on the upper end or the top of the grip and includes a housing 56 of a somewhat generally rectangular box-like configuration having inner rectangular cavity 58 in which is mounted a pair of batteries 60. The batteries are of the dry cell, flashlight or similar type and are mounted within a clip such as a spring clip 62 mounted within the housing 56 and bridging the contacts between the front and rear of the batteries 60. A contact 64 engages the one pole of one of the batteries and includes a contact portion 66 of a switch. Another pole or contact 68 engages the other end of the other battery and includes a spring contact leaf 70 forming the other contact of the circuit switch. A push button 72 mounted on the side and near one end of the housing 56 is positioned to be pressed to force contact leaf 70 into contact or engagement with contact portion 66 and complete that portion of the circuit.

An audible sonic generator as previously described designated by the numeral 74 is mounted within a recess 76 on the cap member 78 of the housing. A pair of contacts 80 extend downward and engage the respective contacts 64 and 68 to place the sonic generator 74 within the circuit. The cap 78 is held in place on the housing and the housing mounted on the upper end of the grip 48 in a suitable manner such as by means of a pair of screws or the like 84. Other forms of mounting the housing and closing or mounting the enclosure on the housing are possible.

The button 72 for closing the switch and activating the circuit of the audible generator is positioned in a convenient place to be engaged by the thumb of a skier. Thus, with a warning device in accordance with the invention, the device is conveniently positioned and built in or mounted on the pole of the skier to be conveniently positioned to be activated. Thus, a skier can easily and conveniently warn another skier of his approach and thereby greatly reduce the likelihood of collision and ultimate injury.

While I have illustrated and described my invention by means of specific embodiments, it is to be understood that numerous changes and modifications may be made therein without departing from the spirit and scope of the invention as defined in the appended claims.

I claim:

1. A skier's warning device comprising in combination:

a ski pole grip having an outer surface formed into a hand fitting configuration, and including a cylindrical bore for detachably mounting said grip on the upper end of a ski pole, a housing detachably mounted on the top of said ski pole grip and including an upwardly opening battery cavity therein, a detachable cover mounted on said housing covering said battery cavity, an audible warning device carried in said housing and comprising a source of electrical power including a battery mounted in said battery cavity in said housing, a sound generating transducer mounted in said cover and directed generally upward along the axis of said bore in a generally forward direction when a pole on which said grip is mounted is held in a normally horizontal position pointing behind a skier, an electrical circuit including a normally open switch disposed on one side of said housing for activation by a thumb for selectively connecting said electrical power to said transducer and including a leaf spring conductor in said battery cavity for defining a portion of said circuit and wherein said switch includes a push button for biasing said leaf spring conductor into engagement with another conductor.

* * * * *